US007403161B2

(12) United States Patent
DiNallo et al.

(10) Patent No.: US 7,403,161 B2
(45) Date of Patent: Jul. 22, 2008

(54) MULTIBAND ANTENNA IN A COMMUNICATION DEVICE

(75) Inventors: Carlo DiNallo, Plantation, FL (US); Marco Maddaleno, Turin (IT)

(73) Assignee: Motorola, Inc., Schaumburg, IL (US)

( * ) Notice: Subject to any disclaimer, the term of this patent is extended or adjusted under 35 U.S.C. 154(b) by 201 days.

(21) Appl. No.: 11/250,339

(22) Filed: Oct. 14, 2005

(65) Prior Publication Data

US 2007/0085747 A1 Apr. 19, 2007

(51) Int. Cl.
*H01Q 1/24* (2006.01)
*H01Q 1/38* (2006.01)

(52) U.S. Cl. ..... 343/702; 343/700 MS; 343/767

(58) Field of Classification Search ..... 343/700 MS, 343/767, 770, 702, 846
See application file for complete search history.

(56) References Cited

U.S. PATENT DOCUMENTS 6,646,610 B2 * 11/2003 Troelsen ..... 343/702
6,650,295 B2 * 11/2003 Ollikainen et al. .... 343/700 MS
6,762,723 B2 7/2004 Nallo et al.

* cited by examiner

*Primary Examiner*—Michael C Wimer
(74) *Attorney, Agent, or Firm*—Pablo Meles

(57) ABSTRACT

An apparatus is disclosed for a multiband antenna (102) in a communication device (100). An apparatus that incorporates teachings of the present invention may include, for example, an antenna having a finite ground surface (201, 401), and an elongated conductor (206, 406) that is characterized by a length and is spaced from the finite ground surface. The elongated conductor has a first slot (208, 408) extending through a substantial portion of the length of the elongated conductor, and a second slot (210, 410) having a shorter length than the first slot. The antenna further has a grounding conductor (216, 416) coupling the finite ground surface to the elongated conductor, and a signal feed conductor (214, 414) coupling to the elongated conductor.

18 Claims, 2 Drawing Sheets

100

102

300

500

MULTIBAND ANTENNA IN A COMMUNICATION DEVICE

FIELD OF THE INVENTION

This invention relates generally to antennas, and more particularly to a multiband antenna in a communication device.

BACKGROUND

With the ubiquity of wireless communications comes a greater demand for communication devices having a number of resonance bands when roaming between carrier networks worldwide. Communication devices capable of supporting intercontinental roaming can require up to four bands to operate among a number of networks. The more bands required the more complex the antenna designs for mobile devices.

SUMMARY

Embodiments in accordance with the invention provide for a multiband antenna in a communication device.

In a first embodiment of the present invention, an antenna has a finite ground surface, wherein the ground surface has a ground plane, an elongated conductor that is characterized by a length and is spaced from the finite ground surface, wherein the elongated conductor is supported on the ground plane by a dielectric spacer, and wherein the elongated conductor has a first slot extending through a substantial portion of the length of the elongated conductor, and a second slot having a shorter length than the first slot, a grounding conductor coupling the finite ground surface to the elongated conductor, and a signal feed conductor coupling to the elongated conductor.

In a second embodiment of the present invention, a communication device has an antenna, a transceiver coupled to the antenna, and a controller programmed to cause the transceiver to exchange signals with a communication system. The antenna has a finite ground surface, an elongated conductor that is characterized by a length and is spaced from the finite ground surface, wherein the elongated conductor includes a first end, a second end, a point intermediate the first end and the second end, a first slot that extends through a substantial portion of the length of the elongated conductor, and a second slot having a substantially shorter length than the first slot, a grounding conductor coupling the finite ground surface to the elongated conductor, and a signal feed conductor coupling to the elongated conductor.

In a third embodiment of the present invention, a communication device has an antenna, and a transceiver coupled to the antenna for exchanging messages with a communication system. The antenna has a finite ground surface, an elongated conductor that is characterized by a length and is spaced from the finite ground surface, wherein at least a substantial portion of the elongated conductor follows a substantially U shaped contour, and wherein the elongated conductor includes a first slot that extends through a substantial portion of the length of the elongated conductor, and a second slot having a shorter length than the first slot, a grounding conductor coupling the finite ground surface to the elongated conductor, and a signal feed conductor coupling to the elongated conductor.

DETAILED DESCRIPTION OF THE DRAWINGS

Figure 1:
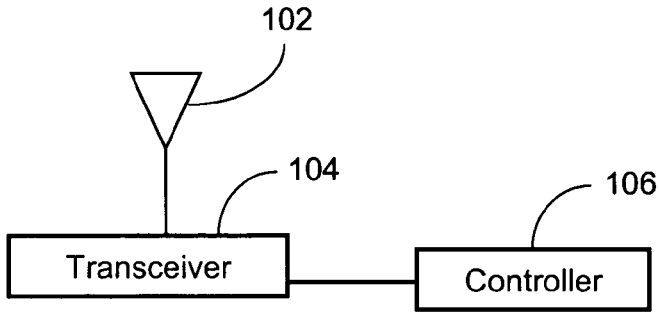
FIG. 1 is a block diagram of a communication device in accordance with an embodiment of the present invention.
Figure 2:
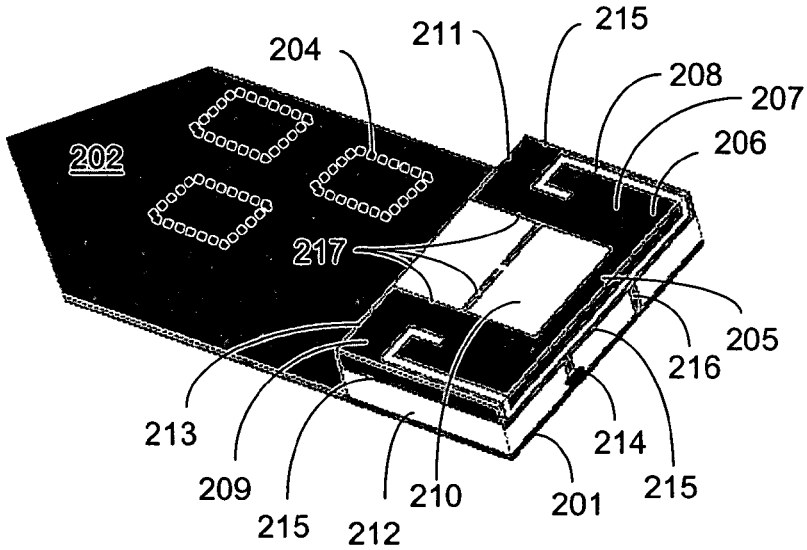
FIG. 2 depicts a perspective view of a first embodiment of an antenna of the communication device according to an embodiment of the present invention.
Figure 4:
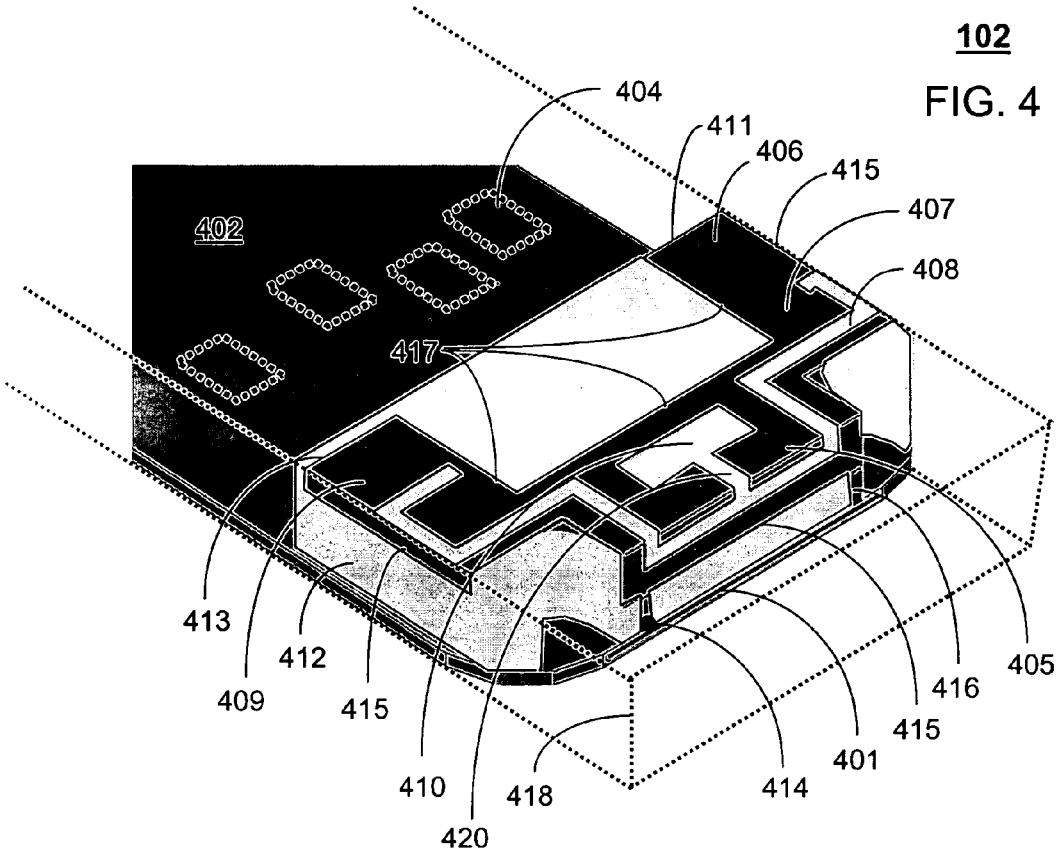
FIG. 4 depicts a perspective view of a second embodiment of the antenna of the communication device according to an embodiment of the present invention.

FIG. 1 is a block diagram of a communication device 100 in accordance with the present invention. The communication device 100 comprises an antenna 102, coupled to a transceiver 104, and a controller 106. The antenna 102 can have any number of embodiments two of which are shown in FIGS. 2 and 4. The transceiver 104 utilizes technology for exchanging radio signals with a radio tower or base station of a communication system according to common modulation and demodulation techniques. The controller 106 utilizes computing technology such as a microprocessor and/or a digital signal processor with associated storage technology (such as RAM, ROM, DRAM, or Flash) for processing signals exchanged with the transceiver 104 and for controlling general operations of the communication device 100.

FIG. 2 depicts a perspective view of a first embodiment of the antenna 102 of the communication device 100 according to an embodiment of the present invention. A finite ground plane 201 of the antenna system 102 is included as one layer, in a multi-layer circuit board 202 of the communication device 100. Alternatively, rather than using a ground plane a ground surface that is not planar can be used. Alternatively, the finite ground plane 201 can be included in several connected layers of the multi-layer board 202. The multi-layer circuit board 202 can be used to support and interconnect other electrical components 204 of the communication device 100 such as the transceiver 104 and the controller 106. In lieu of a multi-layer circuit board, a flexible single or multi-layer circuit substrate can be used.

A generally U-shaped elongated flat conductor 206 is spaced from the circuit board 202, and the finite ground plane 201, by a congruently U-shaped dielectric spacer 212. The U-shape of the elongated flat conductor 206 includes a base segment 205, a first leg 207 extending from the base segment 205, and a second leg 209 extending from the base segment 205. The elongated flat conductor 206 includes a first end 211 at a free end of the first leg 207, and a second end 213 at a free end of the second leg 209. A signal feed conductor 214 connects the base segment 205 of the conductor 206 to the circuit board 202, and a grounding conductor 216 connects the base segment 205 of the conductor 206 to the finite ground plane 201. The signal feed conductor 214, and the grounding conductor 216 can be supported on a portion of a flexible dielectric support, which may or may not be adhesively constrained on the dielectric spacer 212. Although as shown the signal feed conductor 214 and the grounding conductor 216 are located symmetrically with respect to the elongated flat conductor 206, this need not be the case.

As shown, the signal feed conductor 214, and the grounding conductor 216 form a conductive connection to the elongated flat conductor 206. Alternatively, a capacitive break can be made in either or both the signal feed conductor 214, and the grounding conductor 216 so that signals are capacitively coupled to the elongated flat conductor 206. As known in the art, a high capacitance coupling is nearly equivalent to a conductive coupling. Alternatively, a discrete capacitor component can be connected across the capacitive break. As illustrated the signal feed conductor 214, and the grounding capacitor 216 are of uniform width. Alternatively one or both of these conductors can be tapered.

The signal feed conductor 214, and the grounding conductor 216 connect to an external vertical edge 215 of the U-shaped elongated flat conductor 206. The separation between the signal feed conductor 214 and the grounding conductor 216 can be adjusted for impedance matching purposes. The signal feed conductor 214 and the grounding conductor 216 can be separated, for example, between 4 and 30 millimeters.

A first slot 208 is formed in the elongated flat conductor 206. The first slot 208 runs from near the first end 211, then turns through two right angle turns to double back, and runs toward the base segment 205, along a vertical surface of the base segment 205, up the second leg 209, near the second end 211, and makes two more right angle turns to double back. The first slot 208 is closed at both ends. Folding the path of the first slot 208 through successive turns allows a desired length, which length determines the frequency of a slot mode of the antenna 102 to be accommodated within the length of the elongated flat conductor 206. The slot 208 can be between one-quarter and one times a free space wavelength associated with a frequency of the slot mode. The first slot 208 can be less than 5 millimeters wide. Although the first slot 208 has a constant width, alternatively the width of the first slot 208 can be variable.

The length of the external edge 215 of the U-shaped conductor 206 is selected to control the frequency of a common mode of the antenna 102, and the length of an inner edge 217 of the U-shaped conductor 206 is selected to control the frequency of a differential mode of the antenna 102. By controlling the length and width of the elongated flat conductor 206 frequencies of the common and differential modes can be tuned to desired operating bands that are to be supported by the antenna 102. The external edge 215 length of the elongated flat conductor 206 can be in the range of one-eighth to one-half times the free space wavelength associated with the frequency of the common mode. The inner edge 217 length of the elongated flat conductor 206 can be in the range of one-eighth to one times the free space wavelength associated with the differential mode frequency.

The U-shaped conductor 206 can utilize capacitive tabs (not shown in FIG. 2) in an assortment of locations coupled to the conductor 206 to adjust several bands of the antenna 102 such as the common mode, and differential mode frequency bands in accordance with the teachings of DiNallo et al., U.S. Pat. No. 6,762,723, issued Jul. 13, 2004, entitled "Wireless Communication Device Having Multiband Antenna", herein referred to as "DiNallo". Other teachings of DiNallo that are applicable to the present invention are incorporated herein by reference.

A second slot 210 is formed in the elongated flat conductor 206. The second slot 210 is substantially shorter and wider than the first slot 208. Like the first slot 208, the second slot 210 is a closed loop. That is, the second slot 210 is substantially surrounded by the elongated conductor 206. The second slot 210 supports a loop mode at a fourth frequency band. A variance in the surface area of the second slot 210 can affect the tuning of the fourth frequency. In particular, as the surface area of the second slot 210 increases the fourth frequency decreases, and as the surface area of the second slot 210 decreases the fourth frequency increases.

Thus, the antenna 102 as embodied in FIG. 2 supports a common mode at a first frequency, a differential mode at a second frequency, a slot mode at a third frequency, and a loop mode at a fourth frequency. As taught in DiNallo, in the common mode at any given instant current summed over the central cross section of the elongated conductor 206 passes in the elongated conductor 206 in opposite directions. In the differential mode current runs in a common direction on the elongated conductor 206, while in the slot mode current runs in opposite directions on opposite sides of the first slot 208. In the loop mode current runs in circular directions about the second slot 210.

Figure 3:
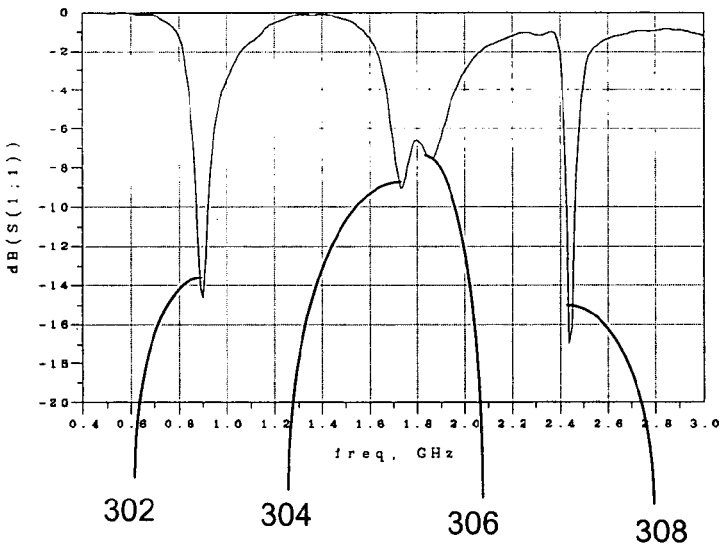
FIG. 3 depicts a spectral performance of the antenna of FIG. 2 according to an embodiment of the present invention.

FIG. 3 depicts a spectral performance of the antenna 102 of FIG. 2 according to an embodiment of the present invention. The common mode is depicted by reference 302, which when tuned can cover 850 MHz and EGSM bands. The differential and slot modes are depicted by references 304 and 306, respectively, and can span from 1710 to 1990 MHz, covering the DCS and PCS bands. The loop mode is depicted by reference 308 which can support a higher frequency band such as 2.4 GHz for applications such as Bluetooth, WiFi (Wireless Fidelity) and/or UMTS (Universal Mobile Telecommunications Service).

From the spectral results of FIG. 3 it would be apparent to an artisan with skill in the art that with antenna 102 the communication device 100 can be configured to support multiband communications with systems such as, for example, GSM (Global System for Mobile), CDMA (Code Division Multiple Access), TDMA (Time Division Multiple Access), UMTS, Bluetooth, WiFi, and WiMax, just to mention a few.

FIG. 4 depicts a second embodiment of the antenna 102 carried by a housing assembly 418 of the communication device 100 according to an embodiment of the present invention. A finite ground plane 401 of the antenna system 102 is included as one layer, in a multi-layer circuit board 402. As in the previous embodiment, the multi-layer circuit board 402 can be replaced with a flexible single or multi-layer circuit substrate.

A U-shaped elongated flat conductor 406 is spaced from the circuit board 402, and the finite ground plane 401, by a dielectric spacer 412. The elongated flat conductor 406 includes a base segment 405, a first leg 407 extending from the base segment 405, and a second leg 409 extending from the base segment 405. The elongated flat conductor 406 includes a first end 411 at a free end of the first leg 407, and a second end 413 at a free end of the second leg 409. A signal feed conductor 414 connects the base segment 405 of the conductor 406 to the circuit board 402, and a grounding conductor 416 connects the base segment 405 of the conductor 406 to the finite ground plane 401. The signal feed conductor 414, and the grounding conductor 416 can be supported on a portion of a flexible dielectric support, which may or may not be adhesively constrained on the dielectric spacer 412. As before, the signal feed conductor 414 and the grounding conductor 416 do not have to be located symmetrically with respect to the elongated flat conductor 206.

The signal feed conductor 414 and the grounding conductor 416 form a conductive connection to the elongated flat conductor 406. Alternatively a capacitive break can be made in either or both the signal feed conductor 414 and the grounding conductor 416 so that signals are capacitively coupled to the elongated flat conductor 406. Alternatively, a discrete capacitor component can be connected across the capacitive break. Although shown uniformly, either of the signal feed conductor 414 and the grounding conductor 416 can be tapered. The signal feed conductor 414, and the grounding conductor 416 connect to an external vertical edge 415 of the elongated flat conductor 406. As in the previous embodiment, the separation between the signal feed conductor 414 and the grounding conductor 416 can be adjusted for impedance matching purposes.

A first slot 408 is formed in the elongated flat conductor 406. The first slot 408 runs from below the first end 411, then turns through one right angle turn, and runs toward the base segment 405, along a vertical surface of the base segment 405, up the second leg 409, below the second end 411, and makes a right angle turn. The first slot 408 is closed at both ends. As in the previous embodiment, folding the path of the first slot 408 through successive turns allows a desired length, which length determines the frequency of a slot mode of the antenna 102, accommodated within the length of the elongated flat conductor 406. Although the first slot 408 as shown has a constant width, alternatively the width of the first slot 408 can be variable.

The length of the external edge 415 of the U-shaped conductor 406 is selected to control the frequency of a common mode of the antenna 102, and the length of an inner edge 417 of the U-shaped conductor 406 is selected to control the frequency of a differential mode of the antenna 102. As with the previous embodiment, controlling the length and width of the elongated flat conductor 406 tunes frequencies of the common and differential modes to desired operating bands that are to be supported by the antenna 102. The U-shaped conductor 406 can utilize capacitive tabs (not shown in FIG. 4) in an assortment of locations coupled thereto to adjust the common mode, and differential mode frequency bands of the antenna 102 in accordance with the teachings of DiNallo.

A second slot 410 is formed in the elongated flat conductor 406. The second slot 410 in the present embodiment is coupled to the first slot 408 by a third slot 420. As before, the second slot 410 is substantially shorter and wider than the first slot 408. Like the first slot 408, the second slot 410 is a closed loop substantially surrounded by the elongated conductor 406. The second slot 410 supports a loop mode at a fourth frequency band. A variance in the surface area of the second slot 410 or in the length of the third slot 420 can affect the tuning of the fourth frequency. Like the first embodiment, as the surface area of the second slot 410 decreases the fourth frequency increases, and vice-versa. In addition, the length of the third slot 420 increases, the fourth frequency decreases and vice-versa.

Figure 5:
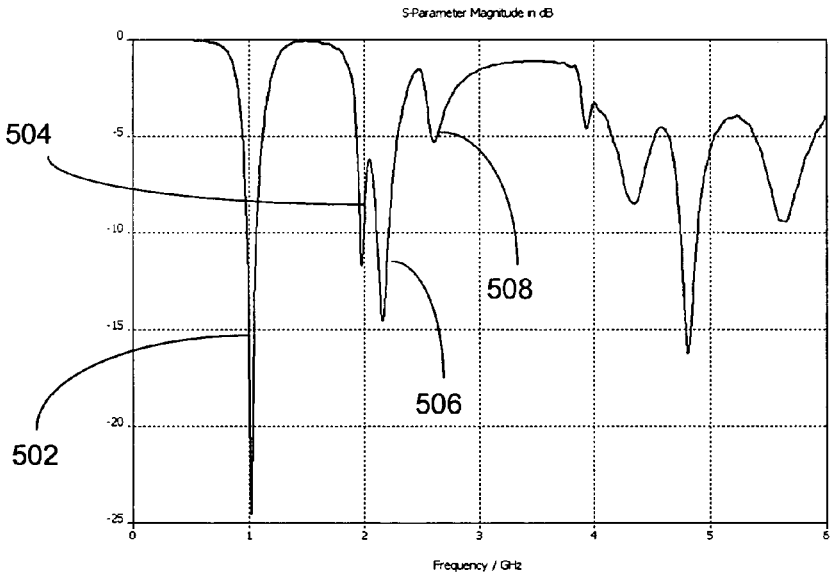
FIG. 5 depicts a spectral performance of the antenna of FIG. 4 according to an embodiment of the present invention.

The antenna 102 of FIG. 4 supports a common mode at a first frequency, a differential mode at a second frequency, a slot mode at a third frequency, and a loop mode at a fourth frequency. FIG. 5 depicts a spectral performance of the antenna 102 of FIG. 4 according to an embodiment of the present invention. The common mode is depicted by reference 502. The differential and slot modes are depicted by references 504 and 506, respectively. The loop mode is depicted by reference 508. Similar to the first embodiment, the antenna 102 of FIG. 4 can be tuned according to the present teachings and those of DiNallo to support four bands across one or communication systems including GSM, CDMA, TDMA, UMTS, Bluetooth, WiFi, WiMax, and others.

The embodiments of the antenna 102 shown in FIGS. 2 and 4 provide for a low profile internal antenna design with multiple frequency responses. Accordingly, these embodiments and/or modifications consistent with the spirit and scope of the claims described below allow for a thin or slim or low profile design of the housing assembly 418—a desirable feature for wireless devices. These embodiments also provide for a variety of tuning variables as taught in the present disclosure and DiNallo. These variables provide for extensive design flexibility in defining the dimensions of the antenna 102 for a variety of housing assembly profiles.

It should be also evident that the present invention may be used for many applications. Thus, although the description is made for particular arrangements and methods, the intent and concept of embodiments herein are suitable and applicable to other arrangements and applications not described herein. It would be clear therefore to those skilled in the art that modifications to the disclosed embodiments described herein can be effected without departing from the spirit and scope of the invention.

Accordingly, the described embodiments ought to be construed to be merely illustrative of some of the more prominent features and applications of the invention. It should also be understood that the claims are intended to cover the structures described herein as performing the recited function and not only structural equivalents. Therefore, equivalent structures that read on the description are to be construed to be inclusive of the scope of the invention as defined in the following claims. Thus, reference should be made to the following claims, rather than to the foregoing specification, as indicating the scope of the invention.

What is claimed is:

1. An antenna, comprising:

a finite ground surface, wherein the ground surface comprises a ground plane;

an elongated conductor that is characterized by a length and is spaced from the finite ground surface, wherein the elongated conductor is supported on the ground plane by a dielectric spacer, and wherein the elongated conductor comprises a first slot extending through a substantial portion of the length of the elongated conductor, and a second slot having a shorter length than the first slot;

a grounding conductor coupling the finite ground surface to the elongated conductor;

a signal feed conductor coupling to the elongated conductor; and a communication circuit capable of processing signals at a first frequency, a second frequency, a third frequency, and a fourth frequency;

wherein the antenna supports:

a common mode, at the first frequency, in which at any given instant current summed over the central cross section of the elongated conductor passes in the elongated conductor in opposite directions;

a differential mode, at the second frequency, in which at any given instant current runs in a common direction on the elongated conductor;

a slot mode, at the third frequency, in which at any given instant current runs in opposite directions on opposite sides of the first slot; and a loop mode, at the fourth frequency, in which at any given instant current runs in circular directions about the second slot.

2. The antenna of claim 1, wherein the second slot is coupled to a portion of the first slot.

3. The antenna of claim 1, wherein a surface area of second slot is substantially surrounded by the elongated conductor.

4. The antenna of claim 3, wherein a variance in the surface area of the second slot affects tuning of the antenna.

5. The antenna of claim 3, wherein an increase in the surface area of the second slot decreases the fourth frequency.

6. The antenna of claim 3, wherein a decrease in the surface area of the second slot increases the fourth frequency.

7. The antenna of claim 1, wherein the elongated flat conductor is U-shaped.

8. A communication device, comprising:

an antenna;

a transceiver coupled to the antenna; and a controller programmed to cause the transceiver to exchange signals with a communication system, and wherein the antenna comprises:

a finite ground surface;

an elongated conductor that is characterized by a length and is spaced from the finite ground surface, wherein the elongated conductor includes a first end, a second end, a point intermediate the first end and the second end, a first slot that extends through a substantial portion of the length of the elongated conductor, and a second slot having a substantially shorter length than the first slot;

a grounding conductor coupling the finite ground surface to the elongated conductor;

a signal feed conductor coupling to the elongated conductor;

wherein the antenna supports:

a common mode, at the first frequency, in which current summed over the center cross section of the elongated conductor passes in the elongated conductor in opposite directions;

a differential mode, at the second frequency, in which current runs in a common direction on the elongated conductor;

a slot mode, at the third frequency, in which current runs in opposite directions on opposite sides of the first slot; and a loop mode, at the fourth frequency, in which current runs in circular directions about the second slot.

9. The communication device of claim 8, wherein the second slot is coupled to a portion of the first slot by way of a third slot in the elongated conductor.

10. The communication device of claim 9, wherein a surface area of second slot is substantially surrounded by the elongated conductor, and wherein a variance in the surface area of the second slot or variance in the length of the third slot affects tuning of the antenna.

11. The communication device of claim 9, wherein an increase in a surface area of the second slot decreases the fourth frequency, and wherein an increase in the length of the third slot decreases the fourth frequency.

12. The communication device of claim 9, wherein a decrease in a surface area of the second slot increases the fourth frequency, and wherein a decrease in the length of the third slot increases the fourth frequency.

13. The communication device of claim 8, wherein the elongated flat conductor has a substantially U-shaped contour.

14. The communication device of claim 8, wherein a portion of the elongated flat conductor has vertical surfaces.

15. The communication device of claim 8, comprising:

a multi-layer circuit, wherein the finite ground surface includes one layer of the multi-layer circuit; and one or more components of the transceiver are located on the multi-layer circuit within the U-shaped contour of the elongated conductor.

16. The communication device of claim 8, comprising a housing assembly for carrying the components of the communication device and substantially reducing external access thereto.

17. A communication device, comprising:

an antenna; and a transceiver coupled to the antenna for exchanging messages with a communication system;

wherein the antenna comprises:

a finite ground surface;

an elongated conductor that is characterized by a length and is spaced from the finite ground surface, wherein at least a substantial portion of the elongated conductor follows a substantially U shaped contour, and wherein the elongated conductor includes a first slot that extends through a substantial portion of the length of the elongated conductor, and a second slot having a shorter length than the first slot;

a grounding conductor coupling the finite ground surface to the elongated conductor;

a signal feed conductor coupling to the elongated conductor; and a communication circuit capable of processing signals at a first frequency, a second frequency, a third frequency, and a fourth frequency;

wherein the antenna supports:

a common mode, at the first frequency, in which at any given instant current summed over the central cross section of the elongated conductor passes in the elongated conductor in opposite directions;

a differential mode, at the second frequency, in which at any given instant current runs in a common direction on the elongated conductor;

a slot mode, at the third frequency, in which at any given instant current runs in opposite directions on opposite sides of the first slot; and a loop mode, at the fourth frequency, in which at any given instant current runs in circular directions about the second slot.

18. The communication device of claim 17, wherein the transceiver is capable of processing signals at a first frequency, a second frequency, a third frequency, and a fourth frequency, wherein a length and a width of the elongated conductor can be varied to adjust the first and second frequencies, wherein a length of the first slot can be varied to adjust the third frequency, and wherein a surface area of the second slot can be varied to adjust the fourth frequency.

* * * * *